US007041917B2

(12) United States Patent
Tada et al.

(10) Patent No.: US 7,041,917 B2
(45) Date of Patent: May 9, 2006

(54) SWITCH FOR ELECTRIC EQUIPMENT, ELECTRIC EQUIPMENT AND ELECTRIC EQUIPMENT MANUFACTURING APPARATUS

(75) Inventors: Hiroaki Tada, Tokorozawa (JP); Isao Watanabe, Tokorozawa (JP); Kenichi Uchiyama, Tokorozawa (JP); Satoshi Ibuki, Tokorozawa (JP)

(73) Assignee: Pioneer Corporation, Tokyo (JP)

( * ) Notice: Subject to any disclaimer, the term of this patent is extended or adjusted under 35 U.S.C. 154(b) by 98 days.

(21) Appl. No.: 10/803,082

(22) Filed: Mar. 18, 2004

(65) Prior Publication Data

US 2004/0231967 A1 Nov. 25, 2004

(30) Foreign Application Priority Data

Mar. 20, 2003 (JP) ..... 2003-077899

(51) Int. Cl.
*H01H 9/00* (2006.01)

(52) U.S. Cl. ..... 200/6 A; 200/341; 200/5 R

(58) Field of Classification Search ..... 200/5 R, 200/5 A, 6 A, 4, 329, 17 R, 296, 337, 341
See application file for complete search history.

(56) References Cited

U.S. PATENT DOCUMENTS 4,394,546 A * 7/1983 Harumatsu ..... 200/5 R
5,523,531 A * 6/1996 Ozaki ..... 200/5 R
5,744,765 A * 4/1998 Yamamoto ..... 200/6 A
6,096,985 A 8/2000 Ritter et al. ..... 200/6
6,359,243 B1 * 3/2002 Nakade et al. ..... 200/6 A
6,396,006 B1 * 5/2002 Yokoji et al. ..... 200/4
6,525,280 B1 * 2/2003 Chan et al. ..... 200/6 A
6,667,447 B1 * 12/2003 Liu et al. ..... 200/5 R

FOREIGN PATENT DOCUMENTS

| | | |
|---|---|---|
| EP | 1 182 677 | 2/2002 |
| JP | 2001-143557 | 5/2001 |
| JP | 2001-35774 | 12/2001 |

OTHER PUBLICATIONS

Partial European Search Report dated Jun. 21, 2004.
Patent Abstracts of Japan vol. 1995, No. 09, Oct. 31, 1995 & JP 7 146728 A (Sony Corp), Jun. 6, 1995 *abstract*.
European Search Report dated Aug. 6, 2004.

* cited by examiner

*Primary Examiner*—Kyung Lee
(74) *Attorney, Agent, or Firm*—Armstrong, Kratz, Quintos, Hanson & Brooks, LLP

(57) ABSTRACT

A switch for electric equipment comprises an operation button (50) arranged at the operation panel side of electric equipment and a plurality of switch bodies (51, 52) adapted to selectively come into contact with a plurality of positions of a front press facet (50P) of the operation button (50) as one of the plurality of positions is depressed, the plurality of positions being disposed oppositely relative to the center of the front press facet (50P). The front press facet (50P) of the operation button (50) is inclined relative to a plane P of arrangement of the switch bodies (51, 52). The front area of the operation button (50) is not reduced when the operation panel side of electric equipment is made to show a low profile so that the user can depress and operate the operation button (50) without difficulty.

7 Claims, 6 Drawing Sheets

SWITCH FOR ELECTRIC EQUIPMENT, ELECTRIC EQUIPMENT AND ELECTRIC EQUIPMENT MANUFACTURING APPARATUS

BACKGROUND OF THE INVENTION

1. Field of the Invention

This invention relates to a switch for electric equipment, a piece of electric equipment and an electric equipment manufacturing apparatus.

2. Description of Related Art

Apparatus for using a DVD (Digital Versatile Disc), a video cassette recorder, game equipment and other pieces of electric equipment each is provided with a disk insertion slot and a switch for electric equipment arranged on the operation panel side of the equipment main body.

Tact switches are known and used for electric equipments. A tact switch includes an operation button having a circular press facet arranged at the operation panel of the equipment main body and a switch body that comes into contact with the press facet of the operation button when the press facet is depressed.

Known tact switches include those having an operation button that can be depressed selectively at a plurality of different positions located oppositely relative to the center of the front press facet so that, when one of the plurality of depressible positions is depressed, the corresponding one of a plurality of switch bodies comes into contact with the operation button.

As prior art, there is a known tact switch that has a plurality of switch bodies arranged along a flat electric base board and a front press facet of an operation button arranged in parallel with the plane of arrangement of the switch bodies (see, Japanese Patent Laid-Open Publication No. 2001-143557, FIG. 11).

Normally, each piece of electric equipment is provided with a flat low-profile casing. The bottom side of the casing operates as support surface and the vertical front side of the flat low-profile casing operates as an operation panel. The operation panel is perpendicular to the support surface of the equipment and a tact switch is fitted to the electric equipment in such a way that its front press facet runs in parallel with the operation panel.

Recently, the casing of electric equipment is often required to show a low-profile (a front side having a reduced height). As a matter of course, the operation panel of the equipment is lowered as the height of the front side of the casing is reduced. As a result, the operation button is required to be small in size.

However, in the case of a tact switch, the operation button of which has a plurality of depressible positions, the user is forced to handle the operation button with difficulty when the size of the press facet of the operation button is reduced. In other words, there is a limit for downsizing the operation button.

SUMMARY OF THE INVENTION

An object of the present invention is to provide a switch for electric equipment, a piece of electric equipment and an electric equipment manufacturing apparatus that allows the operation button to be depressed and operated with ease even when the operation button is fitted to the operation panel of electric equipment having a reduced height.

According to an aspect of the invention, a switch for electric equipment includes: an operation button arranged at the operation panel side of electric equipment; a plurality of switch bodies adapted to come into contact with the operation button when depressed at least at two positions located opposite relative to the center of the front press facet of the operation button; and the front press facet of the operation button being inclined relative to the plane of arrangement of the plurality of switch bodies.

In another aspect of the present invention, there is provided a piece of electric equipment includes: the switch for electric equipment according to the above aspect of the present invention; and an equipment main body having an operation panel carrying the switch for electric equipment.

In still another aspect of the present invention, there is provided an electric equipment manufacturing apparatus for manufacturing electric equipment, the apparatus includes; a casing manufacturing apparatus for manufacturing a casing by injecting a material into a metal mold, the metal mold further including: a fixed mold half for forming the outer surface of the casing; and a movable mold half for forming the inner surface of the casing, the movable mold half being adapted to move toward and away from the fixed mold half, in which the fixed mold half has a first molding section for forming an opening, in which the movable mold half having a second molding section for forming the opening, the movable mold being adapted to abut the first molding section, in which the first molding section is arranged substantially in the direction of the normal to the operation panel, and in which the second molding section being arranged substantially along the support surface of the casing.

DETAILED DESCRIPTION OF PREFERRED EMBODIMENT(S)

Now, an embodiment of the present invention will be described by referring to the accompanying drawings.

Figure 1A:
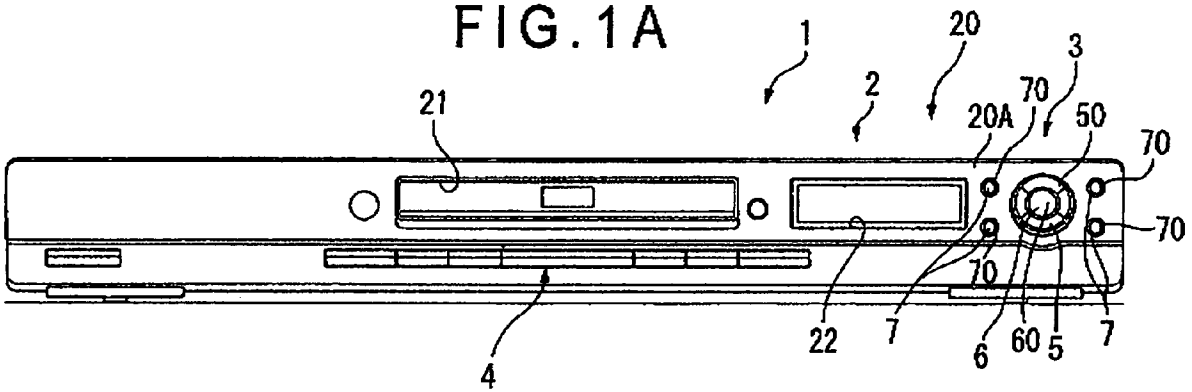
FIG. 1A is a front elevational view showing electric equipment according to an embodiment of the present invention, showing the entire embodiment.
Figure 1C:
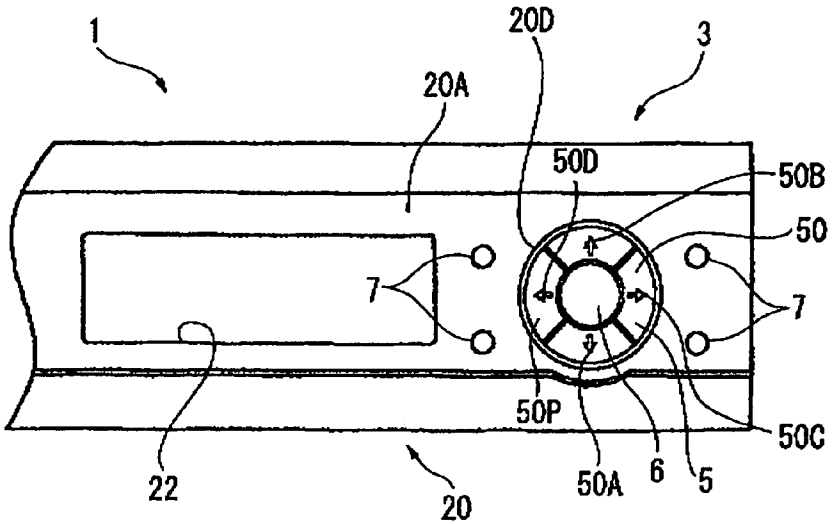
FIG. 1C is an auxiliary view showing the electric equipment, as seen in the direction of arrows indicated by arrows C—C in FIG. 1B.
Figure 1B:
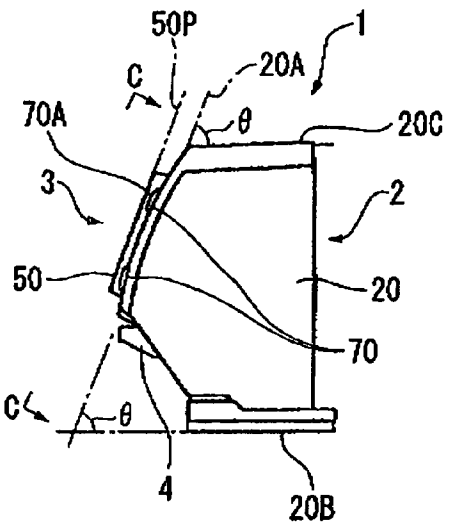
FIG. 1B is a side elevational view showing a part of the electric equipment according to the embodiment of the present invention.

FIGS. 1A through 1C illustrate the overall configuration of electric equipment 1 according to the embodiment. FIG. 1A is a front elevational view of the electric equipment 1 and FIG. 1B is a side elevational view showing a part of the electric equipment 1, whereas FIG. 1C is an auxiliary view showing the electric equipment 1, as seen in the direction of arrows indicated by arrows C—C in FIG. 1B.

Referring to FIGS. 1A through 1C, the electric equipment 1 is a DVD apparatus including a low-profile box-shaped equipment main body 2, a switch 3 for electric equipment arranged on the front side of the equipment main body 2 and a group of operation switches 4 also arranged on the front side of the equipment main body 2.

As shown in FIGS. 1A through 1C, the equipment main body 2 is housed in a casing 20 with its electric components and an operation panel 20A is formed at an upper portion of the front side thereof. A disk insertion slot 21 is formed at the center of the operation panel 20A and a display 22 is arranged next to the disk insertion slot 21, while the switch 3 for electric equipment is arranged next to the display 22. The group of operation switches 4 is arranged in a lower portion of the operation panel 20A.

The casing 20 is made of plastic and formed by injection molding. The casing 20 includes a front surface as shown in FIG. 1B and a main body (not shown).

The switch 3 for electric equipment includes a first switch 5, a key switch 6 arranged at the center of the first switch 5 and four second switches 7 arranged around the first switch 5.

The first switch 5 is a tact switch provided with an operation button 50. Four arrows 50A, 50B, 50C, 50D that respectively correspond to four press positions are shown on the front press facet 50P of the operation button 50. The arrows 50A, 50B, 50C, 50D run in radial directions relative to the front press facet 50P and are angularly separated from adjacent ones by 90 degrees.

The second switches 7 are tact switches, each of which is provided with a button section 70, whereas the key switch 6 is a tact switch that is provided with a key button 60.

As shown in FIG. 1B, the operation panel 20A is inclined to face upward at an angle of θ relative to a support surface 20B of the casing 20 and a top surface 20C of the casing 20. The switch 3 for electric equipment is arranged at the operation panel 20A.

Figure 3:
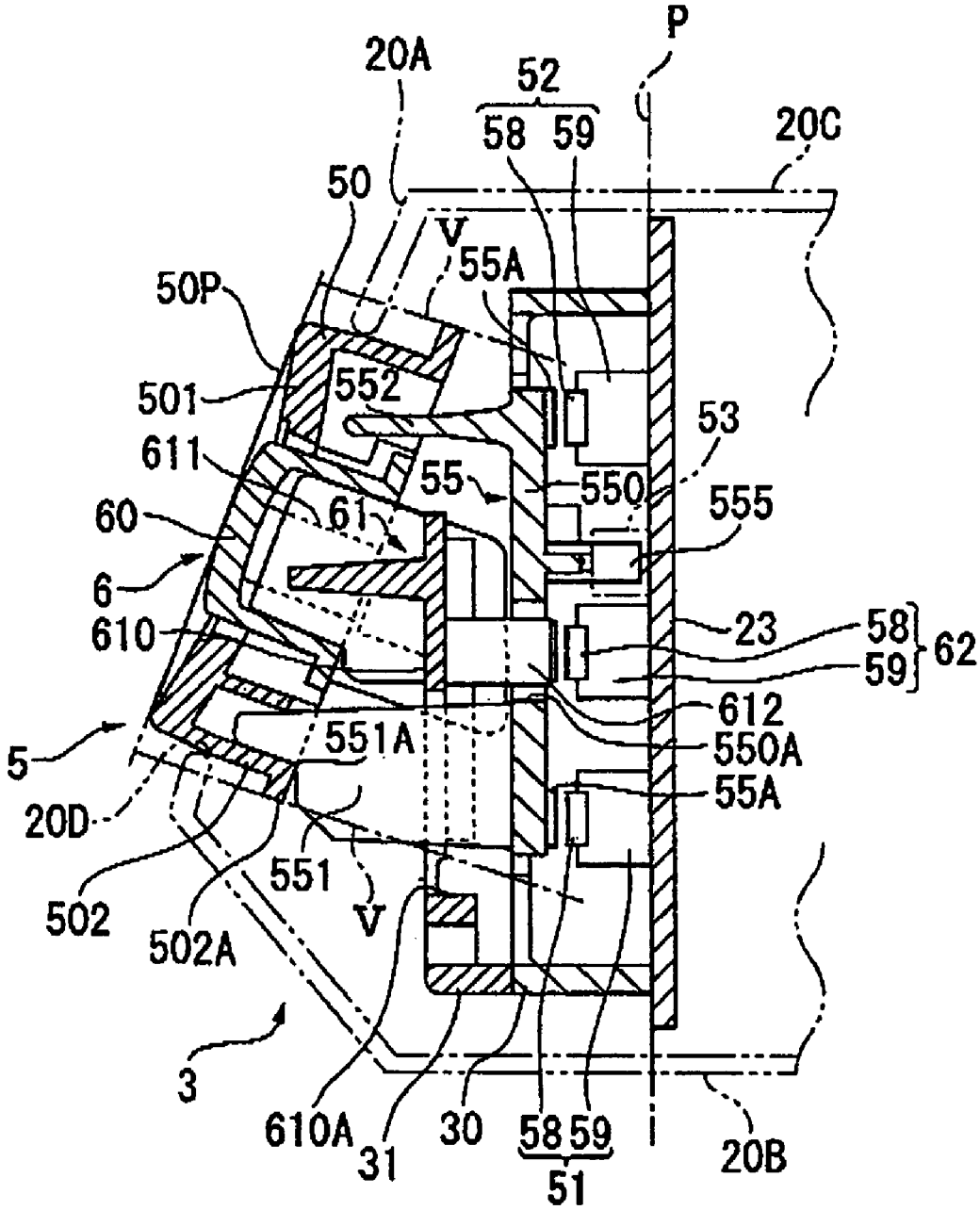
FIG. 3 is a cross sectional view showing the principal part of the switch for electric equipment.

The operation button 50 is arranged at the casing 20 in such a way that its front press facet 50P lies substantially in parallel with the operation panel 20A, while the key button 60 is arranged at the casing 20 in such a way that its front press facet 60P also lies substantially in parallel with the operation panel 20A (see FIG. 3).

Figure 2:
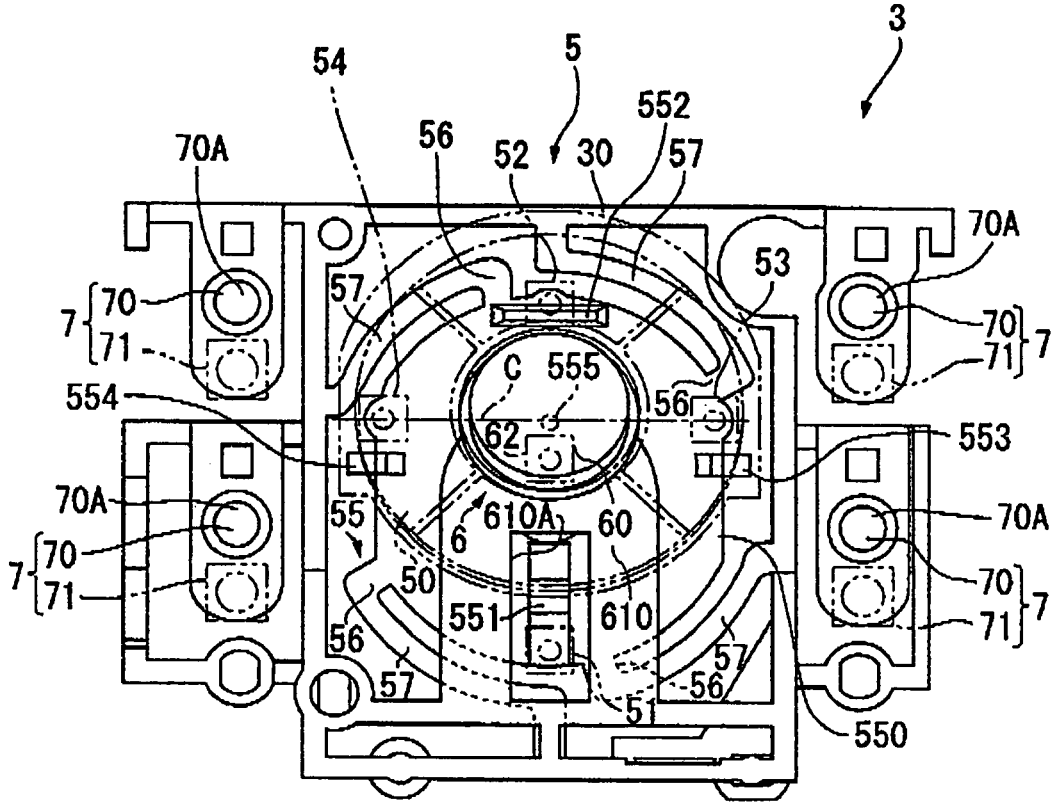
FIG. 2 is a front elevational view showing a principal part a switch for electric equipment.

FIGS. 2 and 3 show the structure of the switch 3 for electric equipment in greater detail.

FIG. 2 is a front elevational view of a principal part of the switch 3 for electric equipment and FIG. 3 is a cross sectional view of a principal part of the switch 3 for electric equipment.

Referring to FIGS. 2 and 3, the first switch 5 includes, in addition to the operation button 50, four switch bodies 51 through 54 that is adapted to come into contact with the front press facet 50P of the operation button 50 when the front press facet 50P is depressed, a link member 55 that links the four switch bodies 51 through 54 and the operation button 50 and an elastic member 57 that urges the operation button 50 linked to the link member 55 by a hinge 56 to the direction opposite to the direction of depression of the front press facet 50P. The elastic member 57 is bound to a frame 30, which is fitted to an electric base board 23. The electric base board 23 is vertically fitted to the support surface 20B of the casing 20.

The operation button 50 is cap-shaped and has a substantially ring-shaped plate-shaped part 501 where the front press facet 50P is formed and a cylindrical part 502 formed around the outer periphery of the plate-shaped part 501 and engaged with the link member 55 along the inner periphery thereof. The operation button 50 is partly exposed to the outside through an opening 20D formed in the casing 20.

The outer peripheral edge of the cylindrical part 502 and the location of the hinge 56 substantially agree with each other as viewed in the direction of normal V relative to the front press facet 50P. However, since the switch 3 for electric equipment in FIG. 2 is found in a front elevational view of the link member 55, the outer peripheral edge of the cylindrical part 502 and the location of the hinge 56 are partly displaced from each other in FIG. 2.

Figure 4A:
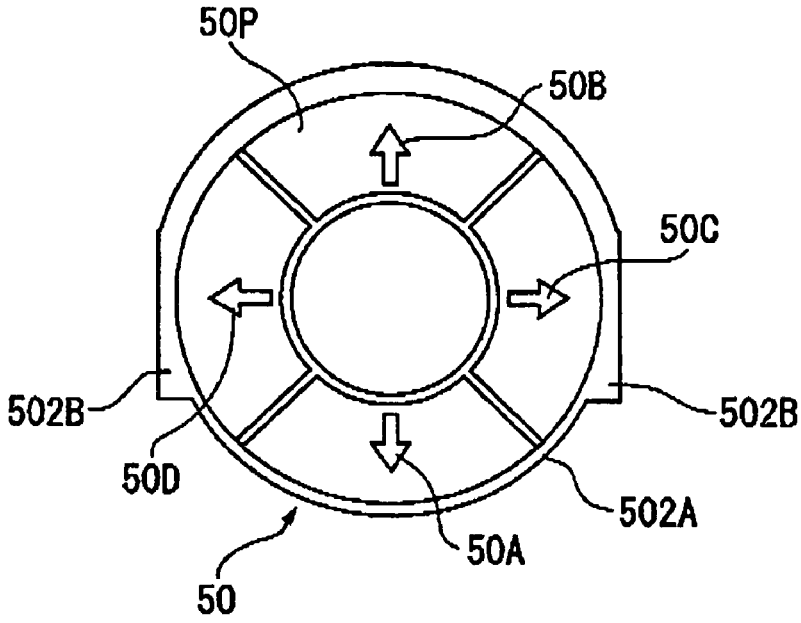
FIG. 4A is a front elevational view showing an operation button.
Figure 4B:
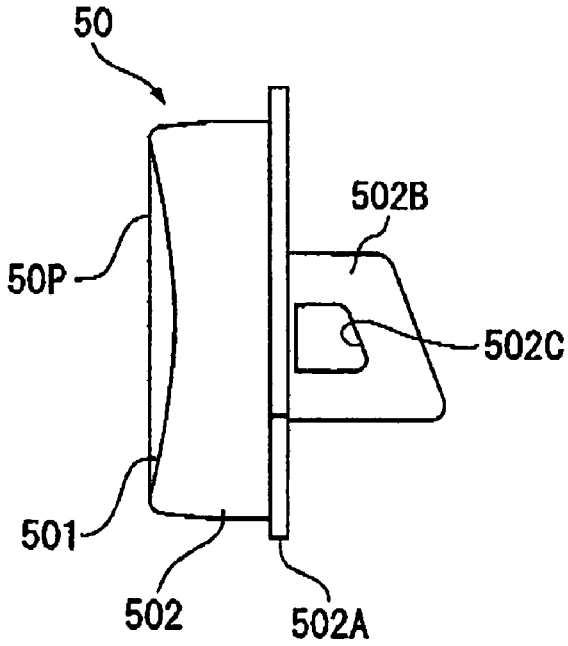
FIG. 4B is a side elevational view showing the operation button.

As shown in FIGS. 4A and 4B, a flange 502A is formed along the edge of the opening of the cylindrical part 502 and engaging projections 502B are formed at positions of the flange 502A that respectively correspond to arrows 50C, 50D and provided with respective engaging holes 502C.

Referring to FIGS. 2 and 3, the four switch bodies 51 through 54 are arranged symmetrically on the electric base board 23. The plane of the electric base board 23 provides the plane P of arrangement of the switch bodies. The positions of the four switch bodies 51 through 54 correspond to those of four arrows 50A, 50B, 50C, 50D as viewed in the normal direction of the plane P of arrangement. Thus, as one of the positions of arrows 50A, 50B, 50C, 50D is depressed, only the corresponding one of the switch bodies 51 through 54 comes into contact with the corresponding position of the operation button 50. Note that only three switch bodies 51 through 53 of the four switch bodies 51 through 54 are shown in FIG. 3.

The switch body 51 has a contact part 58 that is held so as to be able to come into contact with an abutment part 55A formed on the rear surface of the link member 55 and a switch box 59 that supports the retractably projecting contact part 58 and is rigidly secured to the electric base board 23. A contact signal is generated and transmitted when the contact part 58 is retracted.

The other switch bodies 52 through 54 have a structure same as that of the switch body 51.

The frame 30, the elastic member 57, the hinge 56 and the link member 55 are integrally formed by using a resilient plastic material such as ABS resin or the like and the link member 55 is urged to move away from the switch bodies 51 through 54 (in the direction opposite to the direction in which the operation button is depressed) by the resilience of the elastic member 57 so that, as the operation button 50 is depressed, the link member 55 abuts one of the switch bodies 51 through 54 against the resilience of the elastic member 57. In this embodiment, the elastic member 57 is bound at an end thereof to the hinge 56 and at the other end to the frame 30 and formed along the outer peripheral edge of the link member 55 so as to show an arc-shaped profile so that uniform pressure (resilience) is generated regardless if the operation button 50 is depressed at the position of arrow 50A, 50B, 50C or 50D.

The link member 55 has a disk-shaped part 550 arranged substantially in parallel with the plane P of arrangement, an upper arm 551, a lower arm 552, and mid arms 553, 554 standing up from the disk-shaped part 550 toward the operation button 50 with different heights, and a supporting part 555 standing up toward the electric base board 23. The upper arm 551 corresponds to the switch body 51 and the lower arm 552 corresponds to the switch body 52, the upper arm 551 and the lower arm 552 being disposed oppositely with the supporting part 555 interposed between them. One of the mid arms, or mid arm 553 corresponds to the switch body 53, whereas the other mid arm 554 corresponds to the switch body 54, the mid arms 553, 554 being disposed oppositely with the supporting part 555 interposed between them.

The upper arm 551 extends in a radial direction of the disk-shaped part 550 with a small cross section and is provided at the front end thereof with an aligning part 551A for holding the corresponding end of the operation button 50 in position. The part of the upper arm 551 located inside the aligning part 550A on the disk-shaped part 550 operates as engaging projection that engages the inner periphery of the cylindrical part 502 of the operation button 50.

The lower arm 552 extends peripherally relative to the disk-shaped part 550 and is engaged at the front end thereof with the inner peripheral side of the cylindrical part 502 of the operation button 50.

The mid arms 553, 554 are formed peripherally relative to the disk-shaped part 550 and provided at the front ends thereof with respective wedge parts that are engaged with respective engaging holes 502C of the operation button 50.

The front end of the supporting part 555 abuts the electric base board 23 and the disk-shaped part 550 can swing around the supporting part 555.

Each of the second switches 7 has a button 70 and a switch body 71. The switch body 71 has a structure similar to that of the switch body 51.

The button 70 is integrally formed with the frame 30 and its front press facet 70A lies in parallel with the front press facet 50P of the operation button 50 (see FIGS. 1A through 1C).

The part that connect each of the buttons 70 and the frame 30 operates as elastic member so that the button 70 is constantly urged to move away from the corresponding switch body 71. As the front press facet 70A of the button 70 is depressed, it comes into contact with the switch body 71 against the resilience.

The key button 60 has a shape like that of a bottomed hollow cylinder and the front press facet 50P of the operation button 50 can retractably project relative to the central circular part of the key button 60.

The key button 60 is linked to a key switch body 62 by a key linking part 61.

The key linking part 61 has a plate 610 that lies substantially in parallel with the disk-shaped part 550 and closer to the operation button 50 relative to the disk-shaped part 550, an arm 611 for key standing from the plate 610 toward the key button 60 and a supporting part 612 standing from the plate 610 toward the electric base board 23.

The plate 610 is arranged on a frame 31 for key, which is fitted to the frame 30. The key linking part 61 and the frame 31 for key are integrally formed by using a plastic material.

The plate 610 is elastic by itself and constantly urges the key linking part 61 to move away from the key switch body 62. As the front press facet 60P of the key button 60 is depressed, the key linking part 61 comes to contact the switch body 62 against the resilience of the plate 610.

The plate 610 is provided with a long through hole 610A running through the upper arm 551 along the front side of the upper arm 551.

The arm 611 for key is engaged with the inner bottom surface of the hollow cylindrical key button 60 and provided at the front end thereof with a substantially "cross-shaped" engaging part.

The supporting part 612 has its front end inserted into an insertion hole 550A formed at the center of the disk-shaped part 550.

The key switch body 62 has a structure similar to that of the switch body 51.

As shown in FIG. 2, the two switch bodies 51, 52 are arranged oppositely relative to each other with a line segment C interposed between them, which line segment C connects the oppositely disposed switch bodies 53, 54 and passes through the supporting part 555. The mid point of the switch bodies 51, 52 is located at the position of the key switch body 62 that is separated from the line segment C. In other words, the switch bodies 53, 54 are arranged at respective positions offset above from the key switch body 62. On the line segment C, the switch bodies 53, 54 are flush with the supporting part 555 and the switch bodies 51, 52 are arranged on a line segment that perpendicularly intersects the line segment C and passes through the supporting part 555. The length of the combination of the switch body 51 and the supporting part 555 is greater than that of the combination of the switch body 52 and the supporting part 555.

Now, an apparatus for manufacturing electric equipment 1 will be described below.

Figure 5:
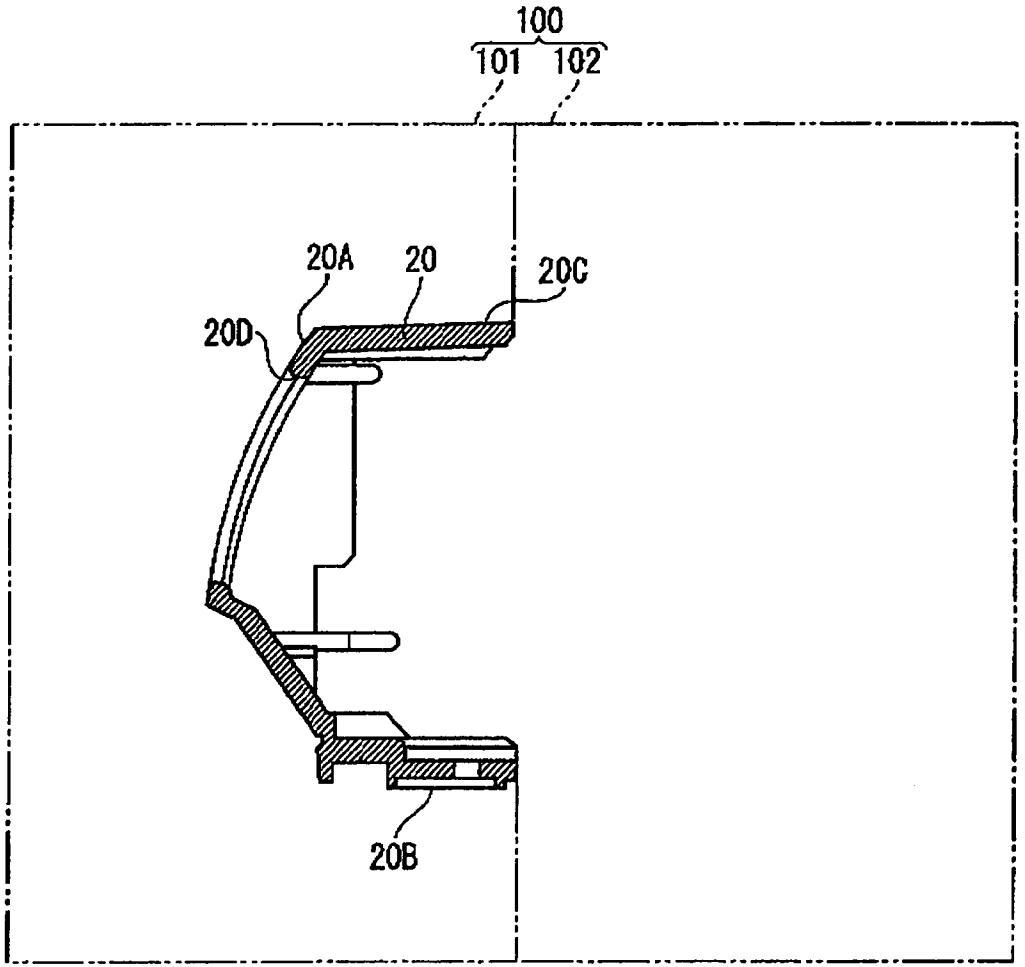
FIG. 5 is a schematic cross sectional view showing a metal mold to be used for manufacturing a casing.
Figure 6:
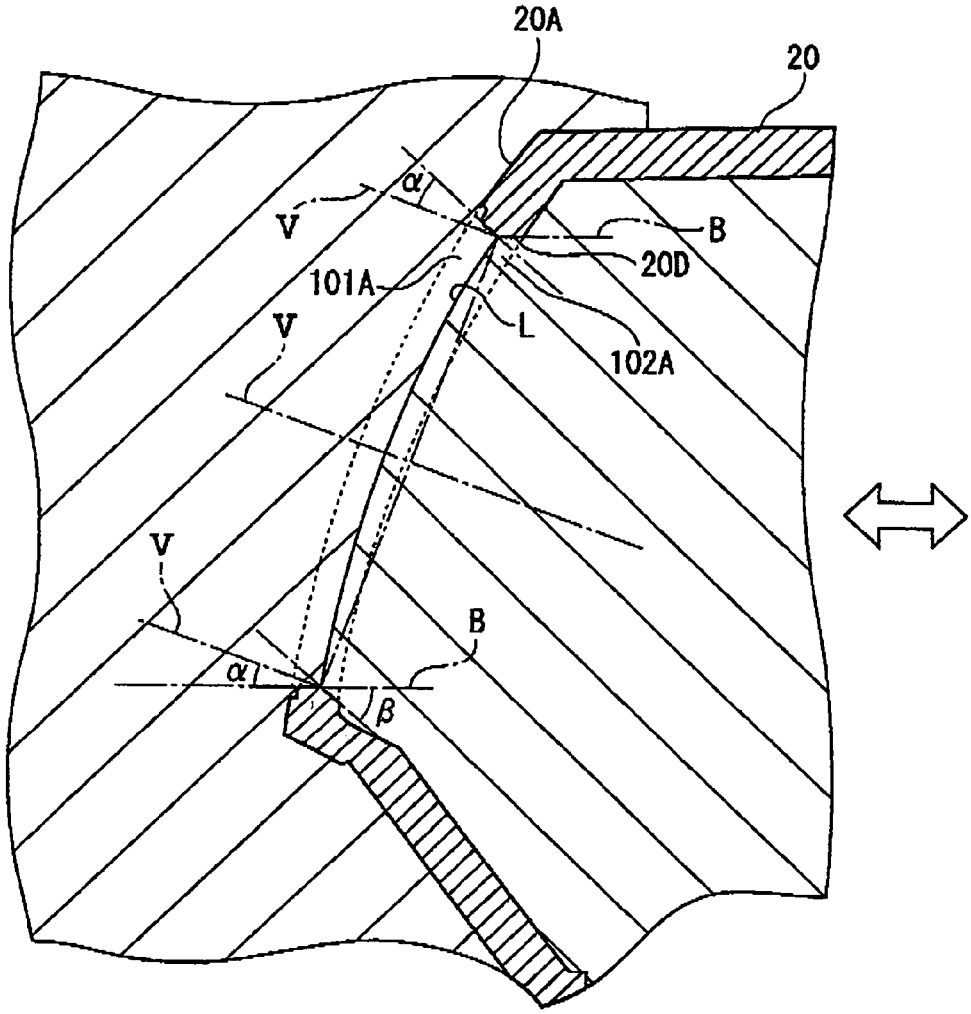
FIG. 6 is an enlarged cross sectional view showing a principal part of the metal mold of FIG. 5.

Firstly, a casing 20 is manufactured by a casing manufacturing apparatus. FIGS. 5 and 6 show an injection molding metal mold 100 to be used for manufacturing a casing 20.

Referring to FIG. 5, the metal mold 100 includes a fixed mold half 101 for producing the outer surface of the casing 20 and a movable mold half 102 for producing the inner surface of the casing 20 that moves toward and away from the fixed mold half 101. The casing 20 is formed by injection molding as molten resin is injected into the cavity defined by the fixed mold half 101 and the movable mold half 102.

FIG. 6 is an enlarged cross sectional view of the metal mold of FIG. 5, showing a principal part thereof for forming the opening 20D of the casing 20 in greater detail.

Referring to FIG. 6, the fixed mold half 101 has at the front end thereof a first molding part 101A for forming the opening 20D). The front end surface L of the first molding part 101A gets to the center of the opening 20D in the sense of the height of the opening 20D. The first molding part 101A extends substantially in the direction of a normal line V relative to the operation panel 20A. To be more accurate, the first molding part 10A is inclined by an angle of $\alpha$ from the normal line V.

The movable mold half 102 has a second molding part 102A that can abuts the first molding part 101A to produce the opening 20D. The front end surface L of the second molding part 102A gets to the center of the opening 20D in the sense of the height of the opening 20D. The second molding part 102A is arranged substantially along a plane B that runs in parallel with the support surface 201 of the casing 20. To be more accurate, the second molding part 102A has a portion that is in parallel with the plane B and an inclined portion that is inclined by an angle of $\beta$ from the plane B.

The electric equipment 1 is manufactured by mounting the switch 3 for electric equipment and internal electric parts that are manufactured separately into the casing 20 manufactured by the casing manufacturing apparatus.

Thus, this embodiment provides the following advantages.

(1) Since the first switch 5 is provided with an operation button 50 that can be arranged at the operation panel side of the electric equipment 1 and four switch bodies 51 through 54, each of which can be brought into contact with a corresponding one of four positions of the operation button 50 arranged symmetrically relative to the front press facet 50P of the operation button 50 located at the center of the front press facet 50P and the front press facet 50P of the operation button 50 is inclined relative to the plane P of arrangement of the switch bodies 51 through 54, the two-dimensional contour of the operation button 50 does not need to be reduced if the operation panel of the electric equipment 1 is made to show a low-profile (a front side having a reduced height). Therefore, the user can depress and operate the operation button 50 without difficulty. Additionally, since the operation button 50 is inclined relative to the front side of the electric equipment 1, the user can operate the operation button 50 not only from the front side but also from above or from a lateral side.

(2) Since the first switch 5 is provided with a link member 55 that links the four switch bodies 51 through 54, the operation button 50 and an elastic member 57 that urges the operation button 50 linked to the link member 55 by the hinge 56 to the direction opposite to the direction of depression of the front press facet 50P, the link member 55 is normally separated from the switch bodies 51 through 54 by the elastic member 57 and comes into contact with one of the switch bodies 51 through 54 only when the operation button 50 is depressed. Thus, the first switch 5 can be realized in the form of a tact switch that operates satisfactorily in terms of contact.

Additionally, since the operation button 50 is cap-shaped and provided with the plate-shaped part 501 where the front press facet 50P is formed and the cylindrical part 502 formed around the outer periphery of the plate-shaped part 501 and engaged with the link member 55 at the inner periphery thereof and the outer peripheral edge of the operation button 50 and the location of the hinge 56 substantially agree with each other as viewed in the direction of the normal line V relative to the front press facet 50P, the hinge 56 can be arranged in the inside of the outer peripheral edge of the operation button 50 to enlarge the front facet of the operation button 50 itself Differently stated, the operation button and the link member may be integrally formed. However, if the operation button and the link member are integrally formed, the operation button that is smaller than the link member needs to be integrally arranged at a central part of the link member from the layout point of view. Then, the operation button may be made large if the link member is made large. However, a large link member does not meet the requirement of downsizing. To the contrary, since the operation button 50 of this embodiment is cap-shaped as pointed out above, the link member 55 can be depressed by using the peripheral edge of the cylindrical part 502 of the operation button 50. Thus, the cylindrical part 502 can be made substantially as large as the link member 55 so that the operation button 50 can be made to have a large size if the link member 55 is not made large.

(3) Since the link member 55 is provided with the disk-shaped part 550 arranged substantially in parallel with the plane P of arrangement, the upper arm 551 and the lower arm 552 standing from the disk-shaped part 550 to respective heights that are different from each other, and the upper arm 551 is provided at the front end thereof with the aligning part 551A for holding the corresponding end of the cylindrical part 502 of the operation button 50 in position, the operation button 50 can be fitted in position with ease simply by pressing the operation button until the operation button abuts the aligning part 551A regardless of the extent of the force applied to the upper arm 551 when fitting the operation button 50 into the link member 55 in the operation of assembling the electric equipment 1.

(4) Since the key button 60 is retractably projecting from a central part of the front press facet 50P of the operation button 50 and linked to the key switch body 62 by the key linking part 61, the key button 60 located at the center of the operation button 50 that can be used for switching operations in four directions can be used as enter key. In other words, a switching operation in one of the four directions and a data entering operation can be conducted instantaneously.

Additionally, since the key linking part 61 is provided with the through hole 610A that runs through the upper arm 551, the key button 60 and the operation button 50 can be laid in a narrow space without interference of each other.

(5) Since the upper arm 551 extends long in a radial direction of the link member 55 with a small cross section and the through hole 610A also extends long along the upper arm 551, the upper arm 551 to which large force is applied when mounting the operation button 50 in position is made to be very strong.

(6) Since the pair of switch bodies 53, 54 of the switch bodies 51 through 54 are arranged oppositely relative to each other while the remaining pair of switch bodies 51, 52 are arranged at respective positions separated from the line segment C connecting the switch bodies 53, 54 and the key switch body 62 that is located on a line passing perpendicularly through the mid point of the line segment C is also separated from the line segment C, the switch bodies 53, 54 are offset from the key switch body 62 respectively in predetermined directions so that if the operation button is depressed clumsily not at a proper area of the front press facet 50P, the switch body that correspond to the depressed area is reliably brought into contact with that area of the front press facet 50P of the operation button 50 to operate properly. More specifically, the front press facet 50P of the operation button 50 is inclined upward relative to the plane P of arrangement and the user may feel difficulty when depressing the area of the front press facet 50P indicated by the downwardly directed arrow 50A. However, since the length of the combination of the switch body 51 and the supporting part 555 is greater than that of the combination of the switch body 52 and the supporting part 555, the pressure applied to the position of the arrow 50A is reliably transmitted to the switch body 51 and hence the area of the arrow 50A is reliably brought into contact with the switch body 51 if the applied pressure is relatively weak.

(7) Since the switch 3 for electric equipment having the above-described configuration and the equipment main body 2 having the switch 3 for electric equipment arranged at the operation panel constitute the electric equipment 1, it is now possible to provide an electric equipment 1 having the above listed advantages (1) through (6).

(8) Since the equipment main body 1 is provided at the side of the operation panel 20A thereof with the casing 20 having the opening 20D through which the operation button 50 is inserted and the operation panel 20A is inclined relative to the support surface 20B of the casing 20 while the operation panel 20A and the front press facet 50P of the operation button 50 are held substantially in parallel with each other, the operation panel 20A and the front press facet 50P of the operation button 50 are arranged in parallel with each other to provide the electric equipment 1 with an improved appearance.

(9) Since the casing manufacturing apparatus is provided and resin is injected into the metal mold 100 to manufacture the casing 20, the casing 20 can be manufactured with ease than ever.

The metal mold 100 is provided with the fixed mold half 101 for producing the outer surface of the casing 20 and the movable mold half 102 for producing the inner surface of the casing 20 that moves toward and away from the fixed mold half 101 and the fixed mold half 101 has the first molding part 101A for forming the opening 20D, while the movable mold half 102 has the second molding part 102A that can abuts the first molding part 101A to produce the opening 20D, the first molding part 101A extending substantially in the direction of the normal line V relative to the operation panel, the second molding part 102A extending substantially along the support surface 20B of the casing 20, the casing 20 having the opening 20D as viewed in the direction of the normal line V can be formed with ease by injection molding.

(10) Since the second switches 7 are arranged around the first switch 5, all or the most of the switches of electric equipment are found in a predetermined area to allow the user to operate the electric equipment 1 with ease.

(11) Since the link member 55, the hinge 56 and the elastic member 57 of the first switch 5 and the button 70 of the second switch 7 are integrally formed with the frame 30 by injection molding, both the first switch 5 and the second switch 7 can be manufactured with ease.

(12) Since the four abutment parts of the link member 55 of the first switch 5 that respectively abut the four switch bodies 51 through 55 are arranged around the supporting part 555 of the disk-shaped part 550 in such a way that the front end of the supporting part 555 abuts the electric base board 23, the disk-shaped part 550 can be swung around the supporting part 555. Therefore, one of the four switch bodies 51 through 54 can be brought into contact with the corresponding area of the front press facet 50P.

(13) When a display for displaying image information of the electric equipment 1 is arranged on the electric equipment 1, the user is forced to operate the operation button 50 located downwardly aslant because the display is positioned at the front of the user. However, with this embodiment, the user does not feel any such inconvenience when operating the operation button 50 because the operation button 50 is inclined upward.

The present invention is by no means limited to the above-described embodiment, configuration of which may be modified or altered without departing from the spirit and scope of the present invention.

For example, while four switch bodies 51 through 54 are provided and the operation button 50 can selectively used at any of the defined four positions thereof in the above-described embodiment, the number of switch bodies and the number of positions at which the operation button can selectively be used are not limited to four according to the present invention and may alternatively be two, three, five, six or more than six. For example, the number of switch bodies and the number of positions at which the operation button can selectively be used may be two. Then, two switch bodies 51, 52 will be provided and two positions indicated by arrows 50A, 50B of the operation button 50 would selectively be used.

The electric equipment 1 according to the present invention may be a game machine, a video deck or some other electric equipment.

While the casing 20 is made of a plastic material in the above description of the embodiment, materials that can be used for the casing 20 are not particularly limited. For example, the casing 20 may alternatively be made of aluminum or some other metal material. A die-casting facility may be used when the casing 20 is formed by using aluminum or the like. Then, the metal mold 10 will be a mold dedicated to die-casting.

While the operation button 50 is formed to show a cap-shaped profile and can be removably fitted to the link member 55 in the above embodiment, the present invention is by no means limited thereto. For example, the operation button 50 may be integrally formed with the link member 55.

The key switch 6 and the second switches 7 may not necessarily be provided. In other words, only the first switch 5 may be provided for the purpose of the present invention.

While the elastic member 57 is formed integrally with the link member 55 by using a plastic material in the above-described embodiment, alternatively, a spring may be used for the elastic member and arranged between the link member 55 and the electric base board 23.

While the front press facet 50P of the operation button 50 is inclined upward in the above embodiment, the arrangement of the front press facet 50P is not limited thereto. Alternatively, it may be inclined downward or sideward. Similarly, the equipment operations surface 20A of the casing 20 may be inclined downward or sideward depending on the direction of inclination of the operation button 50. Alternatively, the angle of inclination of the equipment operations surface 20A may be defined regardless of the direction of inclination of the operation button 50. For example, the operation panel 20A may be made perpendicular relative to the support surface 20B.

Furthermore, the key switch body 62 located at the mid point of the switch bodies 51, 52 is separated downward from the line segment C connecting the oppositely disposed pair of switch bodies 53, 54 in the above-described embodiment. In other words, the switch bodies 53, 54 are upwardly offset in the above embodiment. However, it is not necessary to offset the switch bodies 53, 54 for the purpose of the present invention and the switch bodies 53, 54 may alternatively be aligned with the key switch body 62. When the switch bodies 53, 54 are offset, they may be offset upward as in the case of the above-described embodiment or, alternatively, they may be offset downward. Still alternatively, they may be offset to the right or left of the switch bodies 51, 52.

What is claimed is:

1. A switch for electric equipment comprising:

an operation button arranged at the operation panel side of electric equipment;

a plurality of switch bodies adapted to come into contact with the operation button when depressed at least at two positions located opposite relative to the center of the front press facet of the operation button, the front press facet of the operation button being inclined relative to the plane of arrangement of the plurality of switch bodies;

a link member linking the operation button and the switch bodies;

a hinge; and an elastic member linked to the link member by the hinge and urging the operation button in the direction opposite to the depressing direction of the operation button, wherein the operation button is formed to show a cap-shaped profile having a plate-shaped part carrying the front press facet and a cylindrical part formed around the outer periphery of the plate-shaped part and engaged with the link member along the inner periphery thereof, and the location of the hinge and the outer peripheral edge of the operation button substantially agree with each other as viewed in the direction of a normal line relative to the front press facet.

2. The switch according to claim 1, wherein the link member has a disk-shaped part arranged substantially in parallel with the plane of arrangement, an upper arm and a lower arm, standing up from the disk-shaped part, with a different heights and the upper arm is provided at the front end thereof with an aligning part for holding the corresponding end of the cylindrical part in position.

3. The switch according to claim 2, wherein a key button is arranged at the center of the front press facet of the operation button so as to retractably project and linked to the key switch body by a key linking part and the key linking part is provided with a through hole running through the upper arm.

4. The switch according to claim 3, wherein the upper arm has a long slender profile extending along a radial direction of the link member and the through hole is a long hole running along the upper arm.

5. The switch according to claim 3, wherein the switch bodies include a pair of switch bodies arranged oppositely relative to each other and another pair of switch bodies arranged oppositely relative to a line segment connecting the former pair of switch bodies and the mid point of the latter pair of switch bodies is separated from the line segment.

6. A piece of electric equipment comprising:

a switch for electric equipment including:

an operation button arranged at the operation panel side of electric equipment;

a plurality of switch bodies adapted to come into contact with the operation button when depressed at least at two positions located opposite relative to the center of the front press facet of the operation button, the front press facet of the operation button being inclined relative to the plane of arrangement of the plurality of switch bodies;

a link member linking the operation button and the switch bodies;

a hinge; and an elastic member linked to the link member by the hinge and urging the operation button in the direction opposite to the depressing direction of the operation button, wherein the operation button is formed to show a cap-shaped profile having a plate-shaped part carrying the front press facet and a cylindrical part formed around the outer periphery of the plate-shaped part and engaged with the link member along the inner periphery thereof, and the location of the hinge and the outer peripheral edge of the operation button substantially agree with each other as viewed in the direction of a normal line relative to the front press facet, the electric equipment further comprising:

an equipment main body having a operation panel carrying the switch for electric equipment.

7. The electric equipment according to claim 6, wherein the equipment main body is provided with a casing having an opening formed at the operation panel side so as to allow the operation button to be inserted and the operation panel is inclined relative to the support surface of the casing, the switch for electric equipment being fitted to the casing in such a way that the operation panel and the front press facet are arranged in parallel with each other.

* * * * *